United States Patent [19]

Ikrath, deceased et al.

[11] 4,101,896

[45] Jul. 18, 1978

[54] CAMOUFLAGED DUAL-SLOT ANTENNA

[75] Inventors: Kurt Ikrath, deceased, late of Elberon, N.J., by Gertrude Ikrath, executrix; Paul Sexton, Eatontown, N.J.; Peter Pingitore, Wayside, N.J.; William Kennebeck, Highlands, N.J.

[73] Assignee: The United States of America as represented by the Secretary of the Army, Washington, D.C.

[21] Appl. No.: 787,412

[22] Filed: Apr. 14, 1977

[51] Int. Cl.[2] ..... H01Q 1/32; H01Q 1/38; H01Q 9/00; H01Q 1/50

[52] U.S. Cl. ..... 343/713; 343/700 MS; 343/745; 343/850

[58] Field of Search ..... 343/700 MS, 711, 712, 343/713, 745, 767, 769, 850, 750, 846

[56] References Cited

U.S. PATENT DOCUMENTS

| | | | |
|---|---|---|---|
| 2,996,713 | 8/1961 | Boyer | 343/745 |
| 3,475,755 | 10/1969 | Bassen et al. | 343/700 MS |
| 3,823,404 | 7/1974 | Buie | 343/767 |

FOREIGN PATENT DOCUMENTS

| | | | |
|---|---|---|---|
| 1,050,583 | 1/1954 | France | 343/700 MS |
| 1,457,173 | 12/1976 | United Kingdom | 343/700 MS |
| 1,218,889 | 1/1971 | United Kingdom | 343/713 |

*Primary Examiner*—Alfred E. Smith
*Assistant Examiner*—Harry E. Barlow
*Attorney, Agent, or Firm*—Nathan Edelberg; Sheldon Kanars; Bernard Franz

[57] ABSTRACT

A low profile camouflaged antenna for military vehicles and the like. The antenna comprises an elongated, typically rectangular, sheet of metal curved to conform to the curvature of the vehicle. Insulated spacers, for example of plastic or fiberglass, maintain a fixed spacing between the metal plate and the vehicle, thus forming two elongated slots which, when suitably energized, act as a dual-slot antenna.

5 Claims, 7 Drawing Figures

SWR vs FREQUENCY

CAMOUFLAGED DUAL-SLOT ANTENNA

GOVERNMENT LICENSE

The invention described herein may be manufactured and used by or for the Government for governmental purposes without the payment of any royalties thereon or therefor.

BACKGROUND OF THE INVENTION (a) Field of the Invention

Broadly speaking, this invention relates to antennas. More particularly, in a preferred embodiment, this invention relates to a low profile slot antenna for use on a military tank or the like.

(b) Discussion of the Prior Art

The recent hostilities in the Middle East have clearly demonstrated the need to replace the whip antennas conventionally used on tanks and similar armored vehicles by camouflaged antennas of low or no profile.

Experience has shown that a tank which is equipped with a large whip antenna is a prime candidate for attack by small arms fire or anti-tank missiles, thus jeopardizing the role of such tanks as effective weapons. The reason is, of course, that a tank that has lost its whip antenna in battle is lost to do battle and, most likely, is lost in battle.

Further, even before the commencement of hostilities, in open terrain, such as desert and prairie, a whip antenna tends to reveal the presence of the tank, even if it is otherwise well hidden under camouflaged netting or behind a shielding sand dune, et cetera. Still further, in densely forested jungle terrain, the position of the tank may be obscured by the vegetation but the RF-conducting nature of the vegetation tends to degrade the electrical performance of the antenna due to shielding and scattering.

In the most hostile environment for tanks, the modern city, the operation and performance of a whip antenna mounted to the top of the tank is impaired mechanically and electrically by the steel and concrete structures surrounding it and by the closeness of the combatants in such a situation.

SUMMARY OF THE INVENTION

The problem, then, is to upgrade the role of the tank itself from that of a counterpoise for one dimensional whip antenna to one component of a three-dimensional electro-magnetic antenna system that will improve the quality of the radio communications in all terrains yet at the same time will reduce the exposure of the tank to enemy countermeasures including anti-tank missiles.

Fortunately, the above and other problems have been solved by the slot antenna of the instant invention. In a preferred embodiment, the system provides, in combination with a vehicle having at least one curved body portion, a source of a radio frequency signal and an antenna connected to the source of the radio frequency signal.

The antenna is characterized by an elongated metal plate curved along at least one axis to at least one curved body portion and first and second nonconducting spacing means for respectively maintaining opposed portions of the plate apart from the at least one curved body portion, the first and second spacing means, the plate and the at least one curved body portion defining first and second elongated slots for radiation of radio frequency energy from said source at the frequency of interest.

The invention and its mode of operation will be more fully understood from the following detailed description when taken with the appended drawings in which:

DETAILED DESCRIPTION OF THE INVENTION

Figure 1:
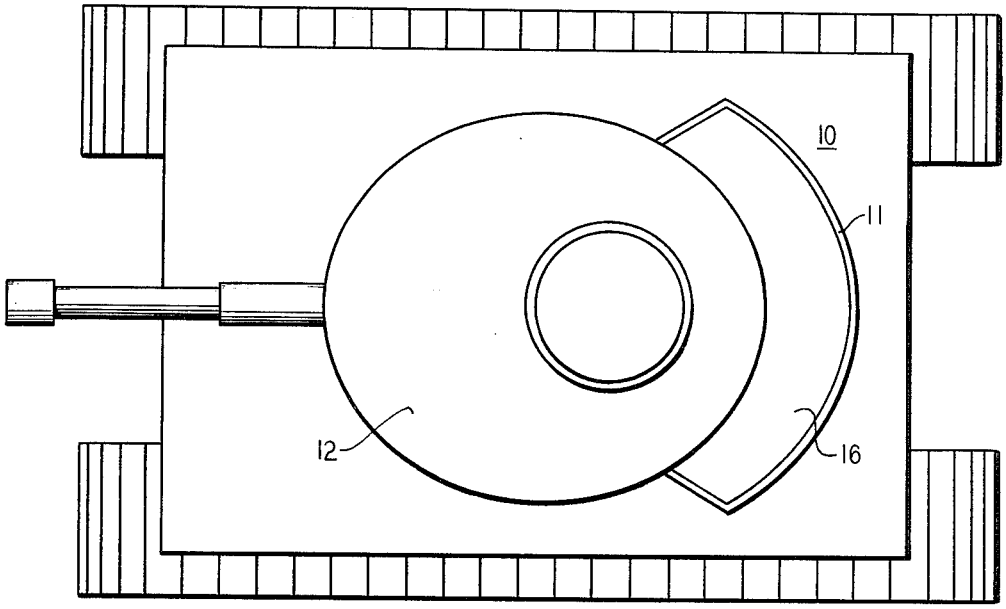
FIG. 1 is a plan view of an illustrative armored vehicle equipped with a dual-slot antenna according to the invention.

The invention will now be described with reference to a particular military vehicle, the M-60 tank, and a particular frequency range, i.e., 30 to 76 MHz. However, it must be emphasized that these are not limiting and that by appropriate modification the antenna disclosed and claimed herein may be used with other vehicles, both military and nonmilitary, and in other frequency bands. For example, the same attributes that make the instant antenna attractive for use on a tank also make it attractive for use on a police vehicle and in this latter case the antenna might be tuned to a frequency in the 150 - 160 MHz band.

The problem of designing a slot antenna for the M-60 tank and the 30 to 76 MHz frequency band is first and foremost a problem of finding space on the tank. Cutting a slot directly into the body or gun turret of the tank is not feasible because of the associated structural and mechanical changes to the basic design of the tank. Space for an externally mounted slot antenna is available only above the engine hood and at the rear of the gun turret, in the vicinity of the bustle rack. The hood above the tank engine could, in theory, be redesigned to act as a slot antenna; however, this antenna would probably be unsatisfactory for the following reasons: (1) the antenna would tend to be detuned by the gun of the tank whenever the gun was positioned in the backward, tied-down position; and (2) the excitation of the slot, via a cable from a transmitter in the turret, would require a special RF slip-ring arrangement.

To avoid the use of slip-rings, which are notoriously unreliable at RF, a decision was made to mount a slot antenna directly onto the gun turret in the vicinity of the bustle rack, which was removed to make space for this purpose. The first attempt at a slot antenna consisted of a 4.6 m long by 2.5 cm wide slot that was backed by a large metal cavity. Because of this large cavity, and the corresponding increase in the silhouette of the gun turret, this first attempt could not be classified as a low silhouette antenna and was thus dropped from further consideration. However, this antenna did make it possible to verify the feasibility of using slot structures to excite a tank as an effective RF radiator in the frequency bands of interest. For example, it was found that the combined radiation from this first experimental slot antenna exhibited a peculiar frequency dependency. That is, at both the lower and higher frequencies, the radiation pattern was essentially omnidirectional. More specifically, the radiation patterns at the lower frequencies were characterized by about equally large maxima in the forward and backward direction and by shallow minima to the sides of the tank. On the other hand, the radiation patterns at the higher frequencies were oval-shaped and had broad maxima in the forward direction of the slot. At the intermediate frequencies, i.e., at around 44 MHz, the radiation was strongly collimated in the backward direction.

It, thus, became evident that the interaction between a traditional type of slot antenna (e.g., an antenna in the form of a single slot backed by a cavity and mounted on the gun turret) and the tank as a counterpoise could not produce the desired, essentially omnidirectional, radiation pattern in the 30 to 76 MHz frequency band. Consequently, the traditional slot antenna design was abandoned in favor of a primary type of RF excitation of the gun turret and tank body.

Figure 2:
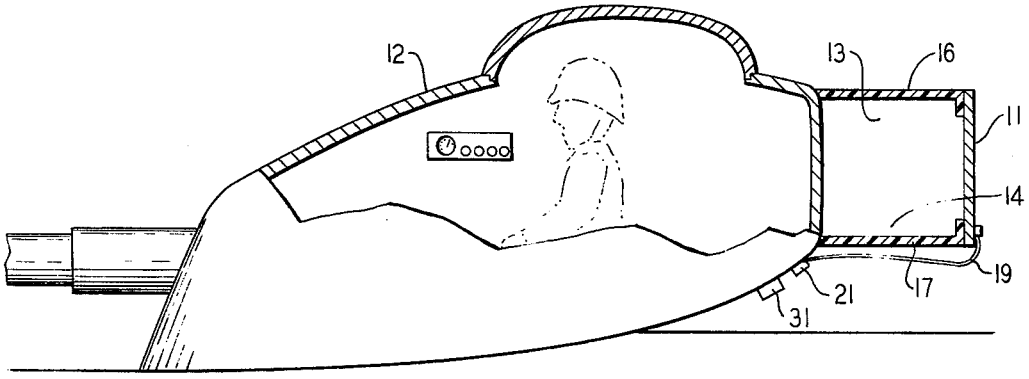
FIG. 2 is a cross-sectional view of a portion of the vehicle shown in FIG. 1 showing the dual-slot antenna in greater detail.
Figure 3:
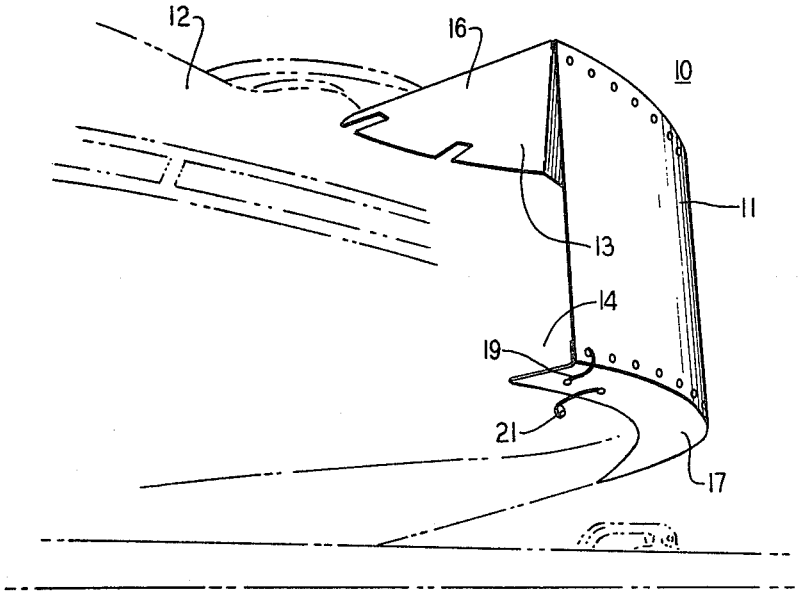
FIG. 3 is an isometric view of a portion of the antenna shown in FIGS. 1 and 2 illustrating its connection to the armored vehicle in greater detail.

FIGS. 1 and 2 are respectively plan and cross-sectional views of the gun turret and slot antenna according to the invention. It will be noted that the dual-slot structure devised for the primary excitation of the tank meets the desired silhouette criteria. As shown, the antenna 10 comprises a sheet of metal 11, e.g., copper or aluminum, approximately 50 cm wide by 200 cm long. The sheet 11 is curved to match the curvature of the gun turret 12. The two slots 13 and 14 of this dual-slot antenna are formed by the gaps between the wall of the turret 12 and the sheet 11. These gaps range from 10 to 30 cm wide in the illustrative embodiment shown. Sheet 11 is maintained in the desired position by means of upper and lower spacers 16 and 17 which are fastened to both the turret 12 and the sheet 11. Of course, the spacers 16 and 17 must be electrically nonconducting and are comprised of plastic in the illustrative embodiment.

Figure 4:
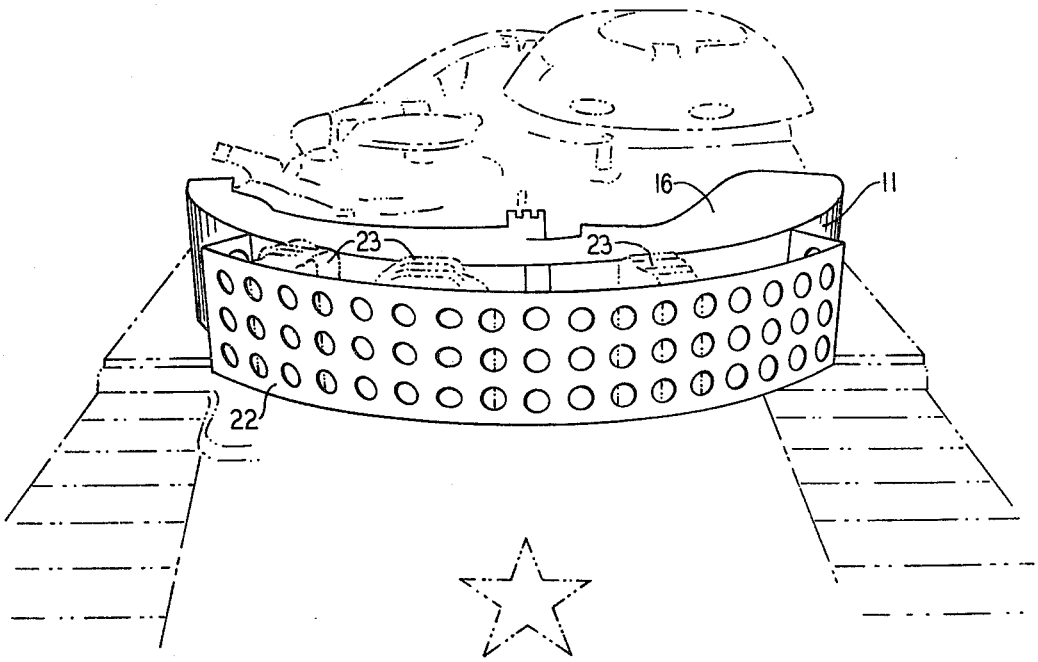
FIG. 4 is another isometric view of the antenna showing an optional bustle rack.

The lower right and left hand corners of metal sheet 11 are galvanically connected by straps 18 and 19, respectively, with the turret 12 via the mounting stubs 21 of the former bustle rack. The remaining stubs 21 are used to support plastic plate 17 by which the bent metal sheet 11 is fastened to the turret 12. Due to the rigidity thus built into the bent metal sheet, the dual-slot antenna structure shown was found to be sufficiently strong to serve as a support for a bustle rack 22. This rack was formed by mounting a metal basket onto the slot structure, the resultant dual-slot bustle rack structure being seen in FIG. 4 loaded with three gas cans 23. In this connection it should be emphasized that the choice of materials (aluminum and plastic) used to construct this experimental dual-slot bustle rack structure was dictated by fiscal limitations. In the preferred embodiment, the structure will be made from copper-plated steel sheet shaped to fit the contours of the turret and the plastic spacers will be replaced with fiberglass stubs to attach the upper and lower parts of the structure to the turret wall.

The impedance-versus-frequency characteristics for different electrical feedpoint locations and for different terminations of metal sheet 11 relative to the back wall of the turret 12 convey the functions of the dual-slot structure. For example, the slot structure degenerates into a capacitor when metal sheet 11 is electrically isolated from turret 12, for example, by breaking the galvanic connections to the turret formed by straps 18 and 19. The impedance of the slot structure was measured with an impedance meter. In one case, the impedance was measured across the middle of the upper slot by connecting the meter probe to the edge of metal sheet 11 and the ground terminal of the probe to the turret wall, via the central mounting stub 21 from the original bustle rack. Further measurements were made using similar connections for the impedance meter but for different slot lengths which were obtained by shorting different sections of the structure.

Comparing the results of these measurements it was noticed that there was a change in the resonance frequencies as the length of the lower slot (i.e., the separation between the galvanic connections to the turret of the points along the lower edge of the metal sheet) was increased. Thus, it was realized that when the length of the lower slot is kept constant and the impedance measurement points, i.e., the RF feed points, are moved along the length of the upper slot the impedance varies. This impedance variation is similar to that which would be obtained in the case of a transformer when the feed tap is moved along the windings of the transformer. It was noted that the feed impedance across the lower slot was generally lower than that across the wider, upper slot. This led to the conclusion that the dual-slot structure could be matched to a 50 Ohm source impedance in various ways; e.g., by varying the slot length, by reactively loading the slot at selected tuning points, by shifting the feed points along the slot and by inserting an impedance matching circuit in the feed line.

Figure 5:
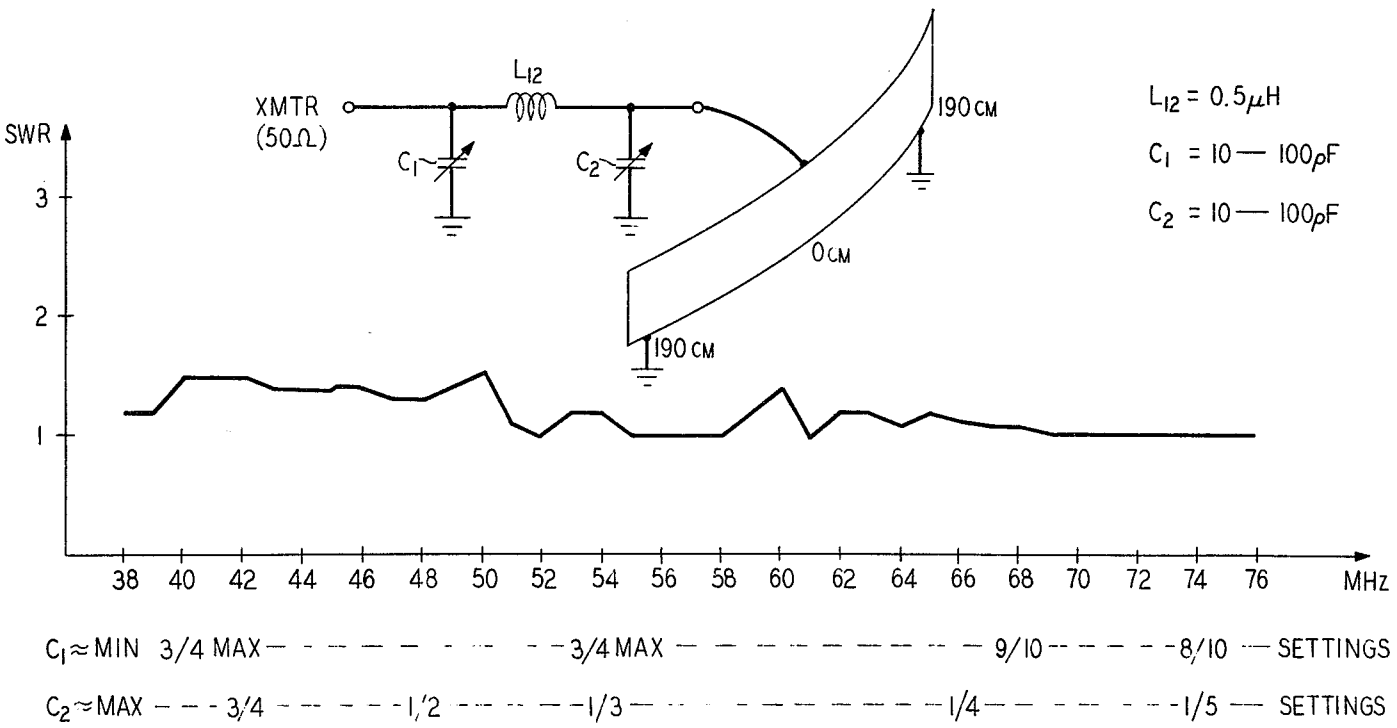
FIG. 5 is a graph showing the SWR ratio versus frequency characteristics of the antenna.

The choice of the RF feed points for the dual slot structure and the related design of the impedance matching circuits were determined by the following constraints: (1) the shortest possible coaxial cable connection from the transceiver inside the gun turret to the upper slot 13 was offered by the existing hole a second whip antenna mount on the left part of the turret; (2) the operationally most convenient way of matching the 50 Ohm coaxial cable to the feed impedance of the upper slot 13 would be to use a matching circuit immediately proximate the feed point. At a length of $20 \times 150$ cm for the lower slot a good match (SWR $\leqq 2$) was achieved in the 36 to 52 MHz range by means of a single tuning capacitor in series with the slot feed and cable terminals. Similarly at a length of $20 \times 194$ cm for the lower slot, a series L-C circuit ($L = 1.6\ \mu H$ and C variable from 10 to 100 pF) provided a perfect match (SWR = 1.0) in the 30 to 38 MHz range. Thus, the dual-slot structure could be tuned over the 30 to 52 MHz frequency range with the same series tuning capacitor by dividing the frequency range into two bands, the lower 30 to 38 MHz band where the $L = 1.6\ \mu H$ coil is in series with the tuning capacitor and the length of the lower slot is adjusted to 194 cm, and the upper 36 to 52 MHz band where the $1.6\ \mu H$ series inductance is shorted and the length of the lower slot reduced to 150 cm. However, under present conditions it would be very difficult to vary the slot length when a tank is in motion. For this reason, the decision was made to keep the length of the lower slot fixed at 194 cm for the complete 30 to 76 MHz frequency range. The impedance match of the feed slot to the 50 Ohm coaxial cable to the 38 to 76 MHz range was then achieved by the use of a PI-circuit comprising a series inductance ($L = 0.5\ \mu H$) connected between two shunt tuning capacitors ($C_1$ and $C_2$ . . . 10 to 100 pF). The performance of the matching circuit is shown in terms of SWR-versus-frequency in FIG. 5. For the 38 – 76 MHz band, essentially similar results were obtained in the 30 – 36 MHz range.

The impedance matching circuit also included a provision for the direction connection of the feed cable to the upper slot terminal. Such direct connections were employed in several experiments in which different parts of the dual-slot structure were shorted and reactively loaded to achieve a 50 Ohm input impedance at the feed terminal. During evaluation of the different impedance matching techniques, the mounting stubs 21 for the original bustle rack were connected by a ¾ inch wide braided-wire grounding strip 31. This grounding strip 31 extended along the wall of the turret, parallel to the lower slot. The grounding strip 31 caused a small reduction in the width of the lower slot and the parasitic eddy current loops on the turret wall along the lower slot. The corresponding electrical effects, in the form of slightly increased slot capacitance and decreased radiation efficiency at the lower and the higher frequencies, respectively, became evident when this ground strip was later removed. The slightly reduced capacitance of the final version of the dual-slot structure, which included a bustle rack 22 (FIG. 4), was later compensated for adding a small trimmer capacitor (1.5 to 7 pF) in shunt with terminals of the matching circuit's series L-C section. In the upper 36 to 76 MHz range, the small impedance change resulting from the removal of the grounding strip was readily compensated for by the slightly different adjustments of the tuning capacitors ($C_1$ and $C_2$) in the PI-section of the matching circuit. It was found that loading the bustle rack with metal objects such as gas cans did not affect the SWR and the radiation efficiency of the antenna. The removal of the grounding strip and the elimination of the associated eddy current paths also improved the overall radiation efficiency of the dual-slot structure.

Satisfactory operation of the dual-slot structure as an efficient VHF radio antenna was initially verified on frequencies around 34 and 44 MHz. At these frequencies, the feed impedance of the dual-slot structure was readily matched to the nominal 50 OHm impedance of the transceiver and feed cable. More specifically, the desired impedance match was obtained by shorting part of the lower slot and by shifting the feed point to the appropriate location along the upper slot. The tank was located under a large tree close to the southern side of a large building during these experiments. From this location, clear voice communications were maintained with a standard whip and transceiver-equipped jeep over a range of about 15 miles. In the same frequency range, voice emissions from other VHF stations were also clearly received via the dual-slot antenna on the tank. Subsequently, the tank was moved to a new location in an open meadow and the experiments resumed. The new location of the tank or possibly the new LC-matching circuit described above, permitted clear voice communications over a range of 18 miles between the tank and the whip-equipped jeep on frequencies of 30.1 MHz and 49.1 MHz. During this voice communications range test, the tank was kept stationary with its engine running and with the gun pointing backward, towards the north. Voice communications tests on 30.1 MHz and 49.9 MHz were resumed the next day. The jeep was kept stationary along the side of the road while the tank was driven in left and right circles at various speeds. Voice communications using the tank's dual-slot structure and the tank's standard whip antenna were compared during these mobile operations. Voice transmissions from the tank using both the whip and the dual-slot structure (with the whip taken off the tank) were clearly received by the jeep's transceiver operating in the squelch-on mode. Similarly, transmissions from the jeep were clearly received by the tank's transceiver (operating in the squelch-on mode) using either the whip or the dual-slot structure. In This latter case, the tank crew noted that the quality of the received voice, in relation to the high acoustical noise background of the moving tank, appeared to be lower whenever the tank happened to turn into the direction of the distant jeep. The lower voice quality under these conditions was particularly noticeable on the 49.9 MHz carrier frequency. These qualitative observations were subsequently confirmed by radiation pattern measurements.

Figure 6:
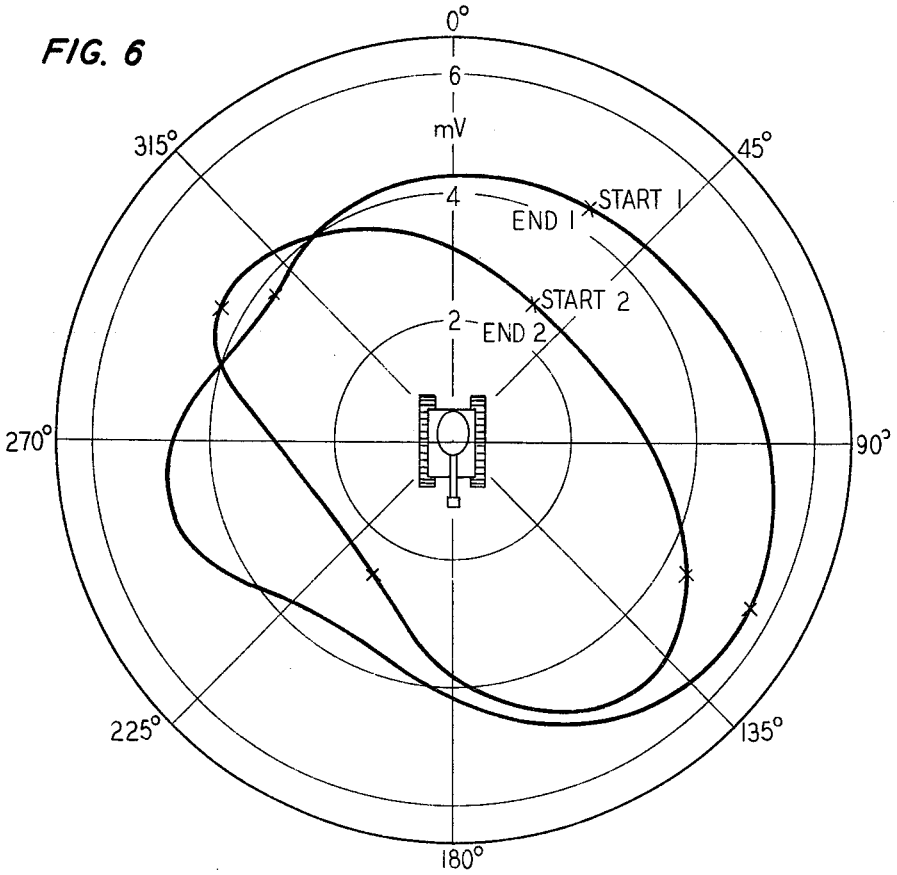
FIGS. 6 and 7 are polar coordinate graphs showing the radiation pattern of the antenna at two discrete frequencies.
Figure 7:
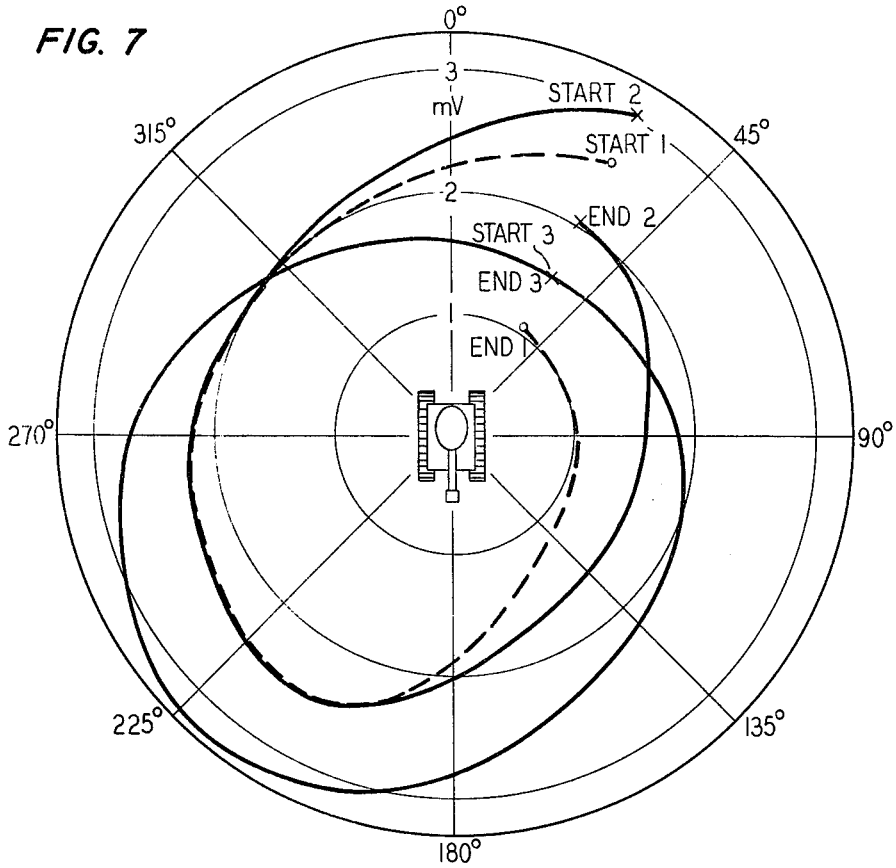

The radiation pattern of the dual-slot coupled tank and its standard whip antenna (which served as reference radiator) were also measured. The radiation pattern measurements were made by driving the tank around in small circles of about 30 to 60 meters diameter and by emitting a CW signal from the tank's transceiver via either the dual-slot structure or the whip antenna. The signal emissions from the tank were picked up by a whip antenna on top of a nearby building. The whip on top of the building was controlled by a transceiver inside the building and connected by RG-58 cable to an RF heterodyne voltmeter inside the building, next to the transceiver. The RF heterodyne voltmeter included an audio detector and speaker circuit as well as a recorder drive circuit. This latter circuit was connected to a linear recorder to record the variations of the received signal level as a function of the orientation of the signal-emitting tank with respect to the direction towards the receiver. The radio operator on the tank conveyed the orientation of the tank, e.g., front, right, back, left, et cetera, via radio to the RF-meter and recorder operator who marked the signal recordings accordingly. The recorded RF signal levels in millivolts were later re-plotted on circular graph paper in the form of radiation patterns. The resultant radiation patterns for a dual-slot coupled tank operating at 30.1 MHz are shown in FIG. 6. The patterns for the left and right-handed paths of the tank have somewhat different shapes but the initial and end values were almost equal in each case so that the patterns are closed curves. This is not the case for the 49.9 MHz patterns shown in FIG. 7. Here, the curves are not closed and the most likely cause for the different initial and end values and related asymmetries of the left and right turn patterns is the increase sensitivity to reflections of the shorter wave lengths at 49.9 MHz. Several metal vehicles and buildings within 100 meters of the path of the tank were suspected as having acted as reflectors which caused the highly position-sensitive interference that perturbated the pattern measurements.

Radiation pattern measurements were repeated in a more suitable environment using the whip antenna on top of the tank as a reference radiator to evaluate the dual-slot structure coupled tank as antenna. During the initial measurements, the previously described grounding strip was mounted along the lower slot and the bustle rack as omitted. The results of these initial measurements show that with increasing frequency the radiation from the dual-slot coupled tank decreases relative to the radiation from the reference whip antenna. The frequency dependence of the radiation from the whip and from the dual slot in the backward direction was subsequently studied in more detail. The measurements confirmed the overall observed trend of decreasing signal levels with increasing frequency. It should be pointed out that the radiation measurements at 49.9 MHz served also to test the different impedance matching techniques which were discussed previously. The 49.9 MHz radiation pattern for the dual-slot shown in FIG. 7 was obtained with the following direct impedance matching scheme. The feed cable was connected directly to the right side of the upper slot which was shorted on its left side at a point which was 150 cm from the center. The lower slot, in turn, was shorted at a point which was 190 cm to the right of center and tuned by a tuning capacitor (10 to 75 pF) connected across the center of the lower slot. The previously described grounding strip was utilized in this slot impedance matching scheme. The 49.9 MHz radiation pattern measurements were then repeated after the bustle rack had been mounted onto the dual-slot structure. Later, the PI-matching circuit was used to match the impedance of the dual-slot structure at the center feed point on the upper slot to the 50 Ohm feed cable. The test showed that with this latter arrangement the radiation patterns of the dual-slot coupled tank and the whip were now practically equal whereas, with the slot shorting type of impedance match, the radiation from the dual-slot coupled tank was lower than that from the whip. The lower radiation efficiency experienced with the use of a grounding strip for impedance matching made the grounding strip suspect as an RF eddy current generator. Consequently, the grounding strip and the associated connectors were completely removed. The effects of this removal were then determined by the new frequency measurements. At the same time, both the vertical and horizontal electrical field components of the received signals were measured. The vertical components were detected by the whip antenna, as before, but the horizontal components were measured by a TV antenna (the 300 Ohm to 50 Ohm impedance transformation for the TV antenna was accomplished by use of a ferrite ring balun transformer). Tests showed that the vertical polarization is dominant in both the whip and the dual-slot case. The improvement in the radiation from the dual-slot antenna relative to the whip was particularly evident at the test frequency of 49.9 MHz. However, the removal of the grounding strip, which improved radiation at the higher frequencies, altered the matching conditions at the lower 30.1 MHz frequency. That is to say, the previous perfect match of the dual-slot feed impedance and the 50 Ohm cable obtained by means of a series L-C matching circuit had been lost. However, this perfect impedance match was then restored by compensating for the distributed capacitance of the removed grounding strip by use of a lumped capacitance in the form of a trimmer capacitor (1.5 to 7 pF) located in the matching circuit for the lower frequency range.

The low-profile, dual-slot coupled tank antenna disclosed and claimed herein has, thus, been proved to be operational in the 30 to 76 MHz range and, in addition, has been shown to work almost as well electrically as a 3 meter high whip antenna on top of the tank turret Further, it has been shown to work as a mount for a bustle rack as well.

One skilled in the art can make various changes and substitutions to the arrangement of parts shown without departing from the spirit and scope of the invention.

What is claimed is:

1. In combination with a vehicle having at least one body portion which is generally vertical and curved in its horizontal projection;

a source of a radio frequency signal; and an antenna connected to said source of said radio frequency signal, said antenna being characterized by:

a metal plate which is generally vertical curved along the horizontal axis to at least partially conform to the curvative of said body portion, so that the plate has upper and lower edges;

nonconducting spacing means to maintain said plate spaced from and generally parallel to said body portion, to define a first slot between the upper edge of said plate and said body portion, and a second slot between the lower edge of said plate and said body portion;

shorting means conductively connecting two grounding points of said plate to said body portion, and feed means connecting a feed point on said plate to said source of a radio frequency signal, said feed point being vertically spaced by a substantial distance from the line between said two ground points and being intermediate said two ground points.

2. The antenna according to claim 1, wherein said plate is elongated along the horizontal axis; said two grounding points are near the two ends of one of said edges, and said feed point is near the other of said edges.

3. The antenna according to claim 2, wherein said two grounding points are near the corners at the ends of the lower edge, and said feed point is near the center of the upper edge.

4. The antenna according to claim 3, wherein said feed means includes impedance matching means comprising an adjustable L-C network.

5. The antenna according to claim 4, wherein said impedance matching means is a PI network which matches the antenna to a source impedance of nominally 50 ohms with a standing wave ratio of less than 2 to 1 over an entire VHF frequency range in which the upper frequency is more than double the lower frequency, the horizontal length of said plate being approximately one half wavelength each side of center at the upper frequency, and the vertical distance between the feed point and the grounding points being approximately one-eighth wavelength at the upper frequency.

* * * * *